US010795389B2

(12) United States Patent
Tyagi et al.

(10) Patent No.: US 10,795,389 B2
(45) Date of Patent: Oct. 6, 2020

(54) LOW LEAKAGE LOW DROPOUT REGULATOR WITH HIGH BANDWIDTH AND POWER SUPPLY REJECTION, AND ASSOCIATED METHODS

(71) Applicant: STMicroelectronics International N.V., Schiphol (NL)

(72) Inventors: Kapil Kumar Tyagi, Greater Noida (IN); Nitin Gupta, Kurukshetra (IN)

(73) Assignee: STMicroelectronics International N.V., Schiphol (NL)

( * ) Notice: Subject to any disclaimer, the term of this patent is extended or adjusted under 35 U.S.C. 154(b) by 0 days.

(21) Appl. No.: 16/217,872

(22) Filed: Dec. 12, 2018

(65) Prior Publication Data

US 2019/0113943 A1 Apr. 18, 2019

Related U.S. Application Data

(62) Division of application No. 15/475,266, filed on Mar. 31, 2017, now Pat. No. 10,198,014.

(51) Int. Cl.

| | |
|---|---|
| ***G05F 1/46*** | (2006.01) |
| ***G05F 1/613*** | (2006.01) |
| ***G05F 1/575*** | (2006.01) |
| *G05F 1/56* | (2006.01) |

(52) U.S. Cl.

CPC ..... *G05F 1/468* (2013.01); *G05F 1/575* (2013.01); *G05F 1/613* (2013.01); *G05F 1/561* (2013.01)

(58) Field of Classification Search

CPC ..... G05F 1/468–1/613

See application file for complete search history.

(56) References Cited

U.S. PATENT DOCUMENTS

| | | | | |
|---|---|---|---|---|
| 6,087,893 | A * | 7/2000 | Oowaki | G05F 1/46 327/537 |
| 9,285,821 | B2 | 3/2016 | Maeda et al. | |
| 2003/0218476 | A1 | 11/2003 | Lindsay et al. | |
| 2006/0267673 | A1* | 11/2006 | Gan | G05F 1/56 327/540 |
| 2006/0284658 | A1 | 12/2006 | Wright | |
| 2011/0248865 | A1* | 10/2011 | Hong | G01S 3/7803 340/870.07 |
| 2012/0256608 | A1 | 10/2012 | Huang | |

(Continued)

FOREIGN PATENT DOCUMENTS

| | | | |
|---|---|---|---|
| CN | 103186157 | A | 7/2013 |
| CN | 103901934 | A | 7/2014 |

*Primary Examiner* — Thienvu V Tran
*Assistant Examiner* — Peter M Novak
(74) *Attorney, Agent, or Firm* — Crowe & Dunlevy

(57) ABSTRACT

An electronic device including a low dropout regulator having an output coupled to a first conduction terminal of a transistor, with a second conduction terminal of the transistor being coupled to an output node of the electronic device. A method for operating the device to switch into a power on mode includes: turning on the low dropout regulator, removing a DC bias from the second conduction terminal of the transistor, and turning on the transistor. A method for operating the device to switch into a power down mode includes: turning off the transistor, forming the DC bias at the second conduction terminal of the transistor, and turning off the low dropout regulator.

22 Claims, 3 Drawing Sheets

(56) References Cited

U.S. PATENT DOCUMENTS

2013/0169246 A1* 7/2013 Shao ..... G05F 1/56
323/266
2015/0241889 A1* 8/2015 Chen ..... G05F 1/67
327/143

* cited by examiner

LOW LEAKAGE LOW DROPOUT REGULATOR WITH HIGH BANDWIDTH AND POWER SUPPLY REJECTION, AND ASSOCIATED METHODS

RELATED APPLICATION

This application is a divisional of U.S. application Ser. No. 15/475,266, entitled "LOW LEAKAGE LOW DROPOUT REGULATOR WITH HIGH BANDWIDTH AND POWER SUPPLY REJECTION", filed Mar. 31, 2017, the contents of which are incorporated by reference in their entirety.

TECHNICAL FIELD

This disclosure is related to the field of low dropout regulators, and more particularly, to a low dropout regulator that utilizes a low voltage ballast transistor for high bandwidth and power supply rejection, and that protects the low voltage ballast transistor from electrical overstresses.

BACKGROUND

Handheld battery powered electronic devices such as tablets and smartphones have been in wide use in recent years, with usage rates that are ever increasing, and with additional functionality being added on a regular basis.

A common type of voltage regulator used in such electronic devices is known as a low dropout (LDO) regulator, which can operate with a small input to output voltage difference, and which provides a high degree of efficiency and heat dissipation. A typical LDO regulator includes an error amplifier that controls a field effect transistor (FET) or bipolar junction transistor (BJT) to cause that transistor to sink or source current from or to an output node. One input of the error amplifier receives a feedback signal, while the other receives a reference voltage. The error amplifier controls the power FET or BJT so as to maintain a constant output voltage.

The power FET or BJT is typically tolerant of 5V, meaning that the FET or BJT therefore has a large area and a low transconductance, however to source or sink a high current, a large transconductance would be required, leading to a very large sized transistor. This in turn leads to high leakage current when the LDO is powered down. In addition, the bandwidth of the LDO is limited by a high input gate to base capacitance to the power FET or BJT. Another drawback of this design is that the power FET or BJT has a large gate to drain or base to emitter capacitance and total gate or drain capacitance due to its size, which results in degradation in high frequency power source noise rejection.

In an attempt to address these drawbacks, additional designs have been devised. For example, a LDO 100 is shown in FIG. 1. In this LDO, amplifier 102 has its inverting input terminal coupled to a reference voltage Vref, its non-inverting input terminal coupled to receive a feedback voltage Vfb, and its output coupled to the gate of p-channel transistor T1. P-channel transistor T1 has its source coupled to a supply voltage Vdd and its drain coupled to node N1. P-channel transistor T2 has its source coupled to node N1, its drain coupled to provide the output of the LDO Vout at node N3, and its gate coupled to the output of amplifier 104. Amplifier 104 has its inverting terminal coupled to node N1 and its non-inverting terminal coupled to receive comparison voltage Vc. A resistive divider formed from series coupled resistances R1 and R2 is coupled between node N3 and ground. A center tap N2 of the resistive divider formed by R1 and R2 is coupled to the non-inverting terminal of amplifier 102 to provide the feedback voltage Vfb thereto.

The transistors T1 and T2 are low voltage devices, and are to be protected from electrical overstresses. When the LDO 100 is operating in a normal power on mode, T2 is biased by amplifier 104 such that it acts as a switch. When the LDO 100 is powered down, node N1 is biased such that neither T1 nor T2 experiences overstresses. However, during the transition between the powered on mode and the powered down mode, or between the powered down mode and the powered on mode, node N1 can intermittently go to supply or ground at a different time constant than node N3, which can also go to ground. Transistor T1 can be stressed because it has no protections against such overstresses, and transistor T2 can be stressed because it is within the feedback loop.

Further development of LDO regulators is necessary to address the aforementioned drawbacks.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Disclosed herein is a method of operating an electronic device including a low dropout regulator having an output coupled to a first conduction terminal of a transistor, with a second conduction terminal of the transistor being coupled to an output node of the electronic device. The method includes placing the electronic device into a power on mode by: turning on the low dropout regulator, removing a DC bias from the second conduction terminal of the transistor, and turning on the transistor. The method also includes placing the electronic device into a power down mode by: turning off the transistor, forming the DC bias at the second conduction terminal of the transistor, and turning off the low dropout regulator.

When placing the electronic device into the power on mode, the transistor may be turned on before the DC bias is removed from the second conduction terminal of the transistor.

When placing the electronic device into the power on mode, the transistor may be turned on after the DC bias is removed from the second conduction terminal of the transistor.

When placing the electronic device into the power on mode, the transistor may be turned on substantially simultaneously with removal of the DC bias from the second conduction terminal of the transistor.

When placing the electronic device into the power down mode, the transistor may be turned off before the DC bias is formed at the second conduction terminal of the transistor.

When placing the electronic device into the power down mode, the transistor may be turned off after the DC bias is formed at the second conduction terminal of the transistor.

When placing the electronic device into the power down mode, the transistor may be turned off substantially simultaneously with forming of the DC bias at the second conduction terminal of the transistor.

Also disclosed herein is an electronic device including an intermediate node, a resistive divider directly electrically connected between the intermediate node and a divider control node, and a low dropout amplifier. The low dropout amplifier includes an amplifier having an inverting terminal receiving a reference voltage, a non-inverting terminal directly electrically connected to a tap node of the resistive divider, and an output, and a ballast transistor having a first conduction terminal coupled to a supply node, a second conduction terminal coupled to the intermediate node, and a control terminal coupled to the output of the amplifier. A transistor has a first conduction terminal coupled to the intermediate node, a second conduction terminal coupled to an output node, and a control terminal. A first impedance is coupled to the output node. A second impedance is coupled to the output node. A first switch is configured to selectively couple the first impedance to the supply node. A second switch is configured to selectively couple the second impedance to the ground node. A third switch is coupled between the intermediate node and the supply node. A fourth switch is coupled between the output of the amplifier and the supply node. A fifth switch that is a three position switch is for selectively coupling the control terminal of the transistor to the supply node or to ground. A sixth switch is coupled between the divider control node and ground.

The first switch may be a PMOS transistor having a source coupled to the supply node, a drain coupled to the first impedance, and a gate biased by the control circuitry.

The second switch may be an NMOS transistor having a drain coupled to the output node, a source coupled to ground, and a gate biased by the control circuitry.

The third switch may be a PMOS transistor having a source coupled to the supply node, a drain coupled to the intermediate node, and a gate biased by the control circuitry.

The fourth switch may be a PMOS transistor having a source coupled to the supply node, a drain coupled to the output of the amplitude, and a gate biased by the control circuitry.

The sixth switch may be an NMOS transistor having a drain coupled to the divider control node, a source coupled to ground, and a gate coupled to an output of an inverter, the inverter having its input coupled to the control circuitry.

The supply node may be at a voltage in a range of 1 to 5 volts.

The supply node may be at a voltage of 1.8V, 2.5V, or 5V.

The ballast transistor may be a low voltage p-channel transistor.

The transistor may be a PMOS transistor.

DETAILED DESCRIPTION

One or more embodiments of the present disclosure will be described below. These described embodiments are only examples of the presently disclosed techniques. Additionally, in an effort to provide a concise description, some features of an actual implementation may not be described in the specification. When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements.

Figure 1:
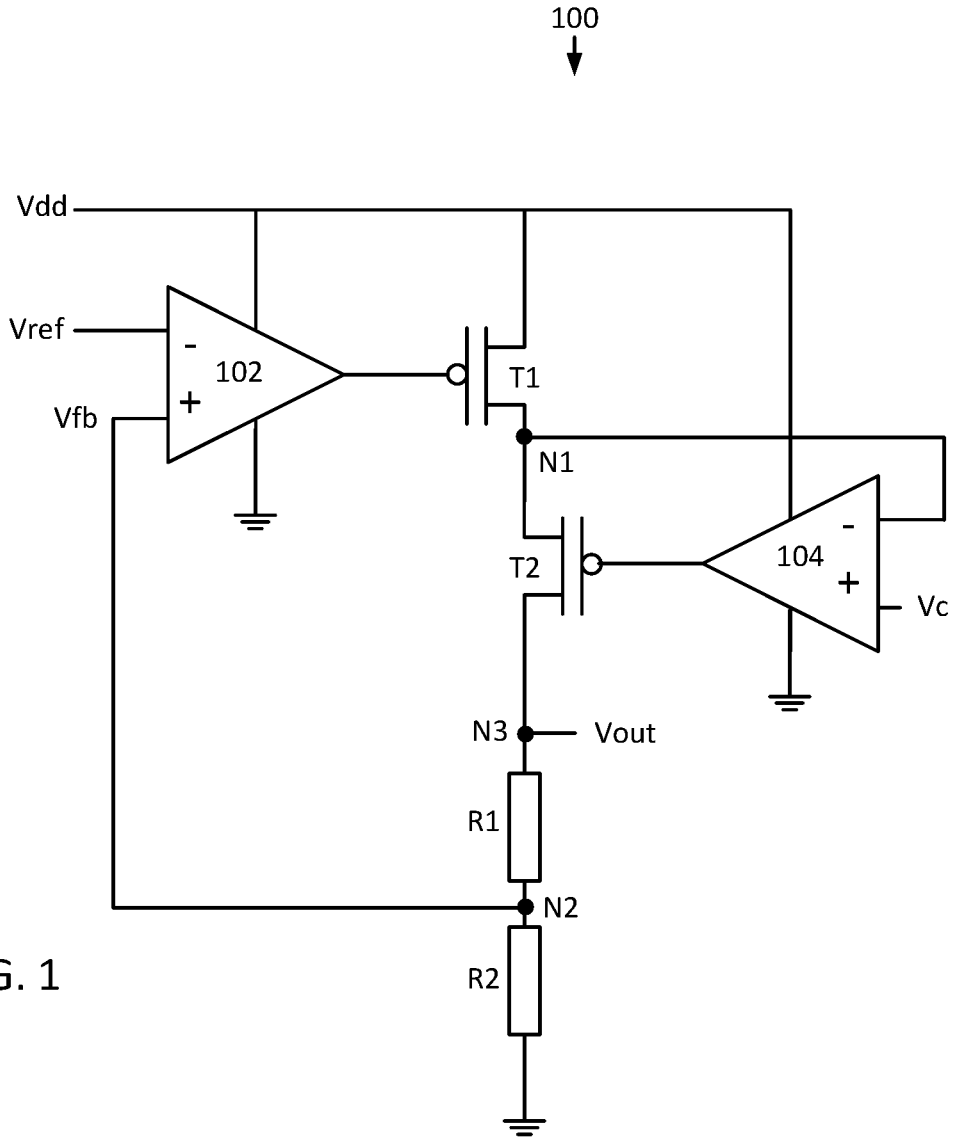
FIG. 1 is a schematic block diagram of a prior art low dropout regulator.
Figure 2:
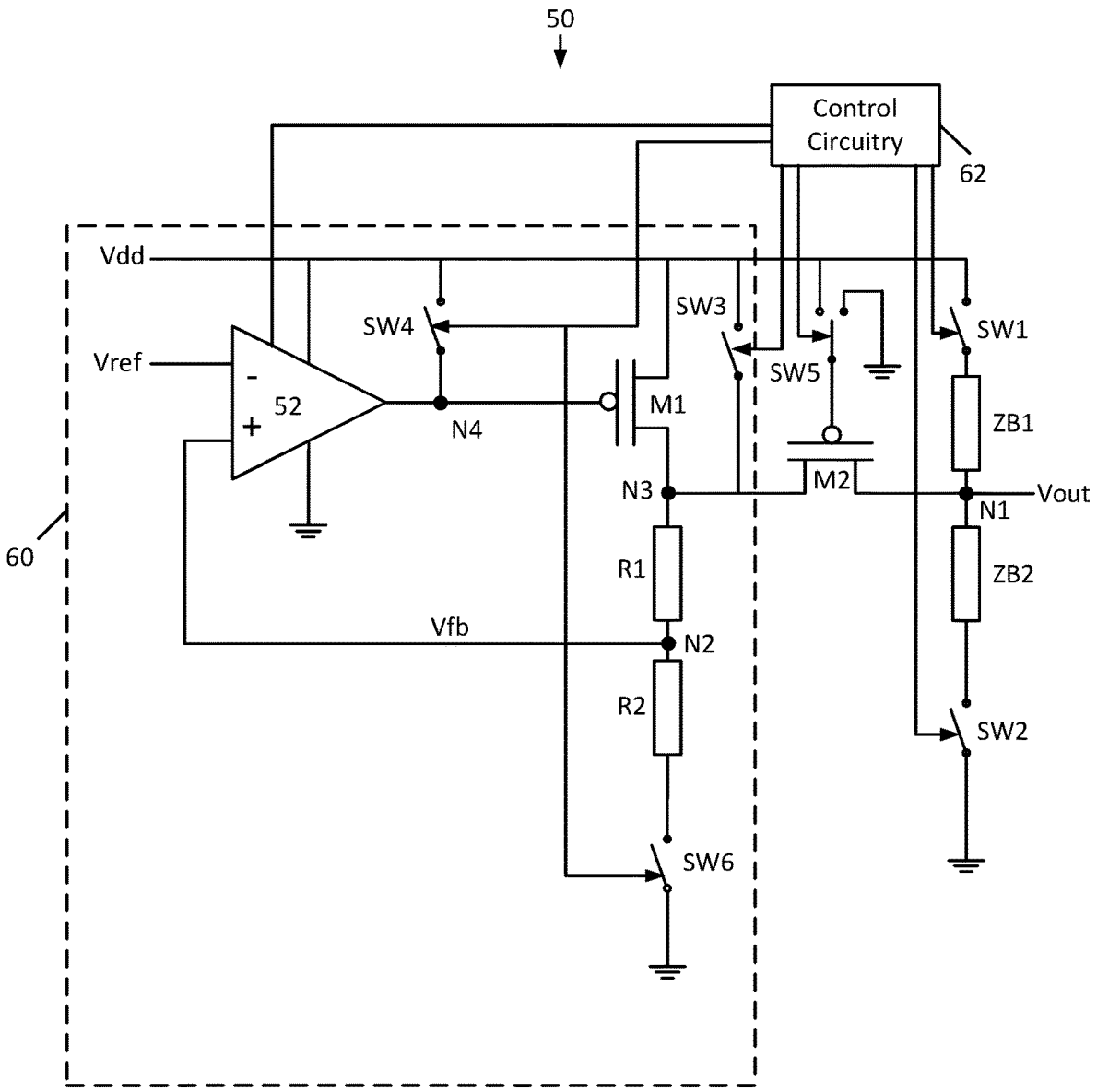
FIG. 2 is a schematic block diagram of an electronic device in accordance with this disclosure.

With reference to FIG. 2, a circuit 50 including a low dropout regulator and its control and bias circuitry is now described. The circuit 50 includes a low dropout regulator 60 receiving a reference signal Vref as input, and providing output to an intermediate node N3.

The low dropout regulator 60 itself is comprised of an error amplifier 52 receiving the reference signal at a first input (non-inverting input terminal), and a feedback signal Vfb at a second input (inverting input terminal), and providing an output to node N4. The error amplifier 52 is powered between a supply voltage Vdd and ground. The supply voltage Vdd may be 5 V, 2.5 V, 1.8 V, 1V a voltage between 1 V and 5 V, or another suitable voltage.

The low dropout regulator 60 includes a low voltage p-channel transistor M1, which may be a PMOS transistor in some cases, and in some cases, may be a low voltage thin gate oxide transistor. The low-voltage p-channel transistor M1 serves as the ballast for the low dropout regulator 60. The p-channel transistor M1 has its source coupled to the supply voltage Vdd, its drain coupled to intermediate node N3, and its gate coupled to node N4 at the output of the error amplifier 52. A switch SW4 selectively couples node N4 (and thus the gate of the p-channel transistor M1) to the supply voltage Vdd. A switch SW3 selectively couples intermediate node N3 (and thus the drain of the p-channel transistor M1) to the supply voltage Vdd.

A first resistance R1 is coupled between the intermediate node N3 and node N2, while a second resistance R2 is coupled between the node N2 and switch SW6. Switch SW6 is coupled between resistance R2 and ground. The first resistance R1 and second resistance R2 may have the same resistance values or may have different resistance values, and in some cases one or both of these resistances R1, R2 may be programmable. R1 and R2 form a resistive voltage divider receiving the voltage at node N3 and outputting a feedback voltage Vfb.

Another low-voltage p-channel transistor M2 has its source coupled to the intermediate node N3, its drain coupled to the output node N1, and its gate selectively coupled to either the supply voltage Vdd or ground by the switch SW5. This p-channel transistor M2 may also be a PMOS transistor in some cases.

A first impedance ZB1 is coupled to the output node N1, and is selectively coupled to the supply voltage Vdd by switch SW1. A second impedance ZB2 is also coupled to the output node N1, and is selectively coupled to ground by switch SW2. The first impedance ZB1 and second impedance ZB2 may have a same impedance value, or may have different impedance values.

The switches SW1, SW2, SW3, SW4, SW5, and SW6 are coupled to control circuitry 62, which serves to control actuation and deactuation of those switches via the generation of appropriate control signals.

The circuit 50 may operate in a powered down mode or a powered on mode. To switch into the powered on mode from a power off condition, the control circuitry 62 first turns on the error amplifier 52, and then opens switches SW6, SW4, and SW3. This serves to activate the low dropout regulator 60.

Then, the control circuitry 62 opens switches SW2 and SW1, removing any DC bias present at the drain of the p-channel transistor M2 at node N1. Thereafter, the control circuitry 62 sets the switch SW5 to couple the gate of transistor M2 to ground, turning the transistor M2 on.

In some cases when switching into the powered on mode, the control circuitry 62 may open switches SW2 and SW1, as well as set the switch SW5 to couple the gate of transistor M2 to ground, substantially simultaneously. In others, the control circuitry 62 may set the switch SW5 to couple the gate of transistor M2 to ground before opening the switches SW2 and SW1.

To switch into the powered down mode, the control circuitry 62 first sets the switch SW5 to couple the gate of the p-channel transistor M2 to the supply voltage Vdd to thereby turn off the p-channel transistor M2. Then, the control circuitry 62 closes the switches SW2 and SW1, forming a DC bias at the drain of the p-channel transistor M2. Thereafter, the control circuitry 62 closes switches SW6, SW4, and SW3, coupling the drain and gate of the p-channel transistor M1 to the supply voltage Vdd, thereby turning the p-channel transistor M1 off. Lastly, the error amplifier 52 is turned off.

In powered down mode, the closing of switches SW6, SW4, and SW3 protects the p-channel transistor M1, as its source, drain, and gate are all coupled to the same supply voltage Vdd. Similarly, the DC bias formed at the drain of the p-channel transistor M2 by the impedances ZB1 and ZB2 helps serve to protect the p-channel transistor M2.

In some cases when switching into the powered down mode, the control circuitry 62 may close switches SW2 and SW1, as well as set the switch SW5 to couple the gate of transistor M2 to the power supply node Vdd, substantially simultaneously. In others, the control circuitry 62 may set the switch SW5 to couple the gate of transistor M2 to the power supply node Vdd before closing the switches SW2 and SW1.

The voltage drop across p-channel transistor M2 is minimal, and neither of the p-channel transistors M1 or M2 are overstressed. However, the p-channel transistor M1 has a higher transconductance than the ballast transistor in prior art designs, and the size of the p-channel transistor M1 can be smaller than in prior art designs. Due to the smaller size of the p-channel transistor M1, the gate to drain capacitance is less than in prior designs. As a result, the p-channel transistor M1 can be fabricated such that the bandwidth of the circuit 50 can be high, and the power supply rejection can be high. Alternatively, the p-channel transistor M1 can be fabricated such that the quiescent current therethrough is substantially lowered, but with the bandwidth and power supply rejection of the circuit 50 remaining the same as prior art devices.

Figure 3:
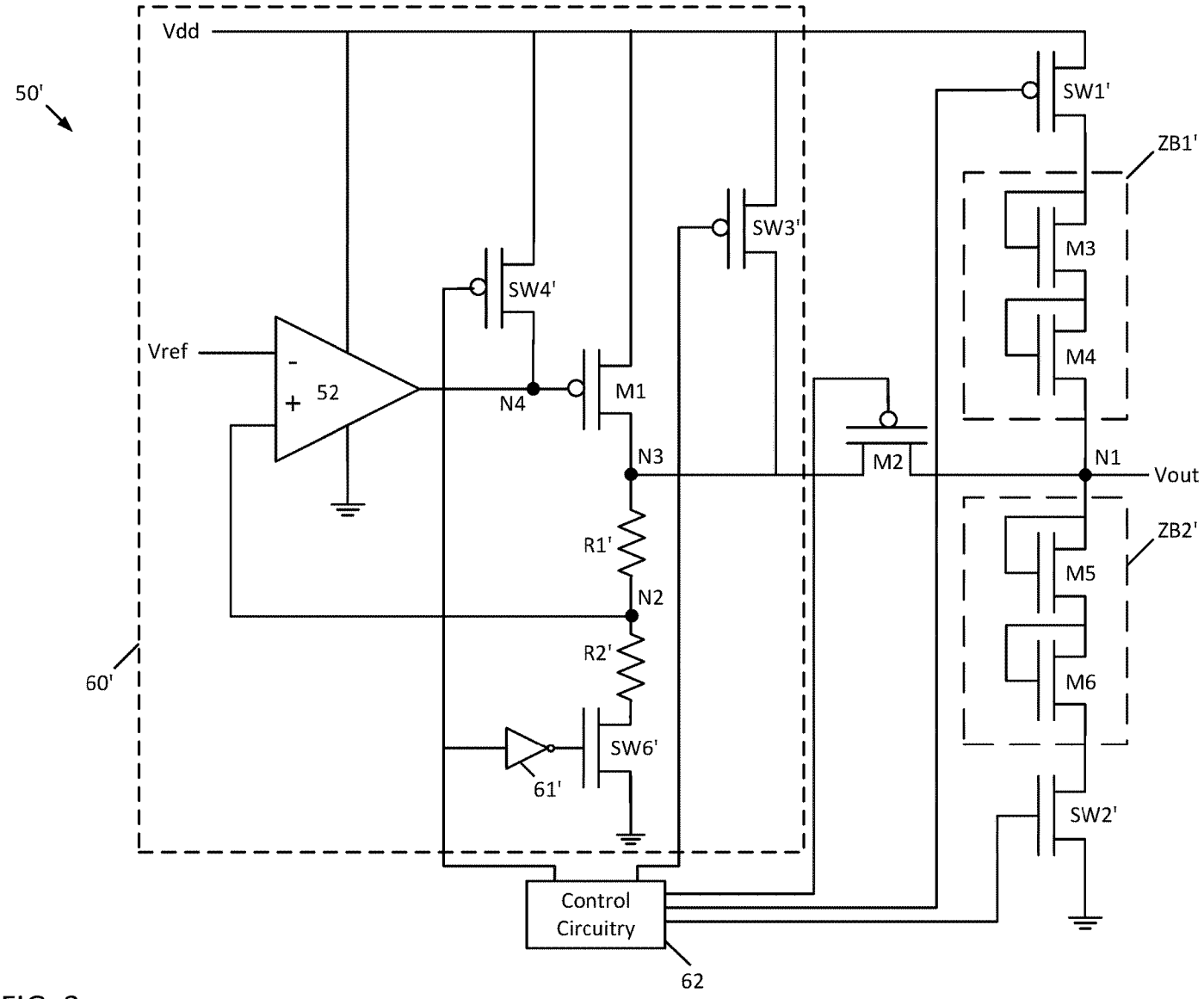
FIG. 3 is a more detailed schematic block diagram of the electronic device of FIG. 2.

With additional reference to FIG. 3, additional details of an additional embodiment are now given. The circuit 50' shown in FIG. 3 operates the same as the circuit 50 shown in FIG. 2, therefore operation details need not be given. Here, the resistances R1' and R2' are resistors, and the impedances ZB1' and ZB2' are each pairs of diode coupled n-channel transistors (such as a NMOS transistors), M3 and M4, and M5 and M6. Switch SW1' is a p-channel transistor (such as a PMOS transistor) having a source coupled to the supply voltage Vdd, a drain coupled to the impedance ZB1', and a gate coupled to the control circuitry 62. Switch SW2' is a n-channel transistor (such as a NMOS transistor) having a drain coupled to the impedance ZB2', a source coupled to ground, and a gate coupled to the control circuitry 62. Switch SW3' is a p-channel transistor (such as a PMOS transistor) having a source coupled to the supply voltage Vdd, a drain coupled to the intermediate node N3, and a gate coupled to the control circuitry 62. Switch SW4' is a p-channel transistor (such as a PMOS transistor) having a source coupled to the supply voltage Vdd, a drain coupled to the gate of p-channel transistor M1, and a gate coupled to the control circuitry 62. Switch SW6' is an n-channel transistor (such as an NMOS transistor) having a drain coupled to resistance R2', a source coupled to ground, and a gate coupled to the control circuitry 62 through an inverter 61.

While the disclosure has been described with respect to a limited number of embodiments, those skilled in the art, having benefit of this disclosure, will appreciate that other embodiments can be envisioned that do not depart from the scope of the disclosure as disclosed herein. Accordingly, the scope of the disclosure shall be limited only by the attached claims.

The invention claimed is:

1. An electronic device, comprising:
- an intermediate node;
- a resistive divider directly electrically connected between the intermediate node and a divider control node;
- a low dropout regulator comprising:
  - an amplifier having an inverting terminal coupled to receive a reference voltage, a non-inverting terminal directly electrically connected to a tap node of the resistive divider, and an output; and
  - a ballast transistor having a first conduction terminal coupled to a supply node, a second conduction terminal coupled to the intermediate node, and a control terminal coupled to the output of the amplifier;
- a first transistor having a first conduction terminal coupled to the intermediate node, a second conduction terminal coupled to an output node, and a control terminal;
- a first impedance coupled to the output node;
- a second impedance coupled to the output node;
- a first switch coupled between the first impedance and the supply node;
- a second switch coupled between the second impedance and ground;
- a third switch coupled between the intermediate node and the supply node;
- a fourth switch coupled between the output of the amplifier and the supply node;
- a fifth switch comprising a three position switch for selectively coupling the control terminal of the first transistor to the supply node or to ground; and
- a sixth switch coupled between the divider control node and ground.

2. The electronic device of claim 1, wherein the supply node is at a voltage in a range of 1 to 5 volts.

3. The electronic device of claim 1, wherein the supply node is at a voltage of 1.8V, 2.5V, or 5V.

4. The electronic device of claim 1, wherein the ballast transistor comprises a low voltage p-channel transistor.

5. The electronic device of claim 1, wherein the first transistor comprises a PMOS transistor.

6. The electronic device of claim 1, further comprising control circuitry configured to enable or disable the amplifier, and to control the first, second, third, fourth, fifth, and sixth switches.

7. The electronic device of claim 6, wherein the first switch comprises a PMOS transistor having a source coupled to the supply node, a drain coupled to the first impedance, and a gate biased by the control circuitry.

8. The electronic device of claim 6, wherein the second switch comprises an NMOS transistor having a drain coupled to the output node, a source coupled to ground, and a gate biased by the control circuitry.

9. The electronic device of claim 6, wherein the third switch comprises a PMOS transistor having a source coupled to the supply node, a drain coupled to the intermediate node, and a gate biased by the control circuitry.

10. The electronic device of claim 6, wherein the fourth switch comprises a PMOS transistor having a source coupled to the supply node, a drain coupled to the output of the amplifier, and a gate biased by the control circuitry.

11. The electronic device of claim 6, wherein the sixth switch comprises an NMOS transistor having a drain coupled to the divider control node, a source coupled to ground, and a gate coupled to an output of an inverter, the inverter having its input coupled to the control circuitry.

12. The electronic device of claim 6, wherein the control circuitry operates to switch the electronic device into a powered on state from a powered off state by enabling the amplifier and opening the third, fourth, and sixth switches to thereby turn on the low dropout regulator.

13. The electronic device of claim 12, wherein the control circuitry further operates to switch the electronic device into the powered on state from the powered off state by, after turning on the low dropout regulator, opening the first and second switches to remove DC bias present at the output node.

14. The electronic device of claim 13, wherein the control circuitry further operates to switch the electronic device into the powered on state from the powered off state by setting the fifth switch to couple the control terminal of the first transistor to ground to thereby turn on the first transistor.

15. The electronic device of claim 14, wherein the control circuitry further operates to switch the electronic device into the powered on state from the powered off state by opening the first and second switches and setting the fifth switch to couple the control terminal of the first transistor to ground.

16. The electronic device of claim 14, wherein the control circuitry further operates to switch the electronic device into the powered on state from the powered off state by setting the fifth switch to couple the control terminal of the first transistor to ground prior to opening the first and second switches.

17. The electronic device of claim 6, wherein the control circuitry operates to switch the electronic device into a powered off state from a powered on state by setting the fifth switch to couple the control terminal of the first transistor to the supply node to thereby turn off the first transistor.

18. The electronic device of claim 17, wherein the control circuitry further operates to switch the electronic device into the powered off state from the powered on state by closing the first and second switches to thereby form a DC bias at the output node.

19. The electronic device of claim 18, wherein the control circuitry further operates to switch the electronic device into the powered off state from the powered on state by closing the first and second switches and setting the fifth switch to couple the control terminal of the first transistor to the supply node.

20. The electronic device of claim 18, wherein the control circuitry further operates to switch the electronic device into the powered off state from the powered on state by setting the fifth switch to couple the control terminal of the first transistor to the supply node prior to closing the first and second switches.

21. The electronic device of claim 18, wherein the control circuitry further operates to switch the electronic device into the powered off state from the powered on state by, after forming the DC bias at the output node, closing the third, fourth, and sixth switches to thereby couple the second conduction terminal and control terminal of the ballast transistor to the supply node to thereby turn off the ballast transistor.

22. The electronic device of claim 21, wherein the control circuitry further operates to switch the electronic device into the powered off state from the powered on state by, after turning off the ballast transistor, turning off the amplifier.

* * * * *